US006878007B1

(12) United States Patent
Decker

(10) Patent No.: US 6,878,007 B1
(45) Date of Patent: Apr. 12, 2005

(54) POWER CORD PLUG AND JACK RETAINER AND HANGER

(76) Inventor: Selden M. Decker, 160 Lismore Ave., Glenside, PA (US) 19038

( * ) Notice: Subject to any disclaimer, the term of this patent is extended or adjusted under 35 U.S.C. 154(b) by 0 days.

(21) Appl. No.: 10/686,260

(22) Filed: Oct. 14, 2003

(51) Int. Cl.[7] ..... H01R 13/62
(52) U.S. Cl. ..... 439/369; 439/373; 248/63; 248/328
(58) Field of Search ..... 439/369–373; 248/63, 248/328

(56) References Cited

U.S. PATENT DOCUMENTS

| | | | | |
|---|---|---|---|---|
| 3,030,601 A | | 4/1962 | Krebs | 339/75 |
| 3,048,810 A | | 8/1962 | Steen | 339/75 |
| 4,143,934 A | | 3/1979 | Siebert | 339/75 P |
| 4,145,105 A | * | 3/1979 | Dobson | 439/369 |
| 4,183,603 A | | 1/1980 | Donarummo | 339/75 |
| 4,643,505 A | | 2/1987 | House et al. | 339/75 P |
| 4,726,780 A | | 2/1988 | Thackeray | 439/223 |
| 4,784,612 A | | 11/1988 | Ryan | 439/367 |
| 4,884,979 A | | 12/1989 | Budner | 439/369 |
| 4,911,654 A | | 3/1990 | Blaetz | 439/372 |
| 4,927,377 A | | 5/1990 | Bach et al. | 439/367 |
| 4,940,424 A | | 7/1990 | Odbert | 439/369 |
| D319,382 S | | 8/1991 | Hunter | D8/354 |
| 5,037,324 A | | 8/1991 | Scheffey, Sr. | 439/452 |
| 5,069,634 A | | 12/1991 | Chiarolanzio | 439/353 |
| 5,110,303 A | | 5/1992 | Hardy | 439/367 |
| 5,135,409 A | | 8/1992 | Thompson | 439/367 |
| D332,940 S | | 2/1993 | Finlay | D13/154 |
| 5,211,570 A | | 5/1993 | Bitney | 439/320 |
| 5,211,573 A | | 5/1993 | Cross | 439/369 |
| D337,309 S | | 7/1993 | Mally | D13/155 |
| 5,306,176 A | | 4/1994 | Coffey | 439/367 |
| D346,787 S | | 5/1994 | Cullen | D13/154 |
| 5,443,397 A | | 8/1995 | Carl | 439/369 |
| 5,567,172 A | * | 10/1996 | Thibault et al. | 439/371 |
| 5,582,524 A | | 12/1996 | Sanner et al. | 439/369 |
| 5,584,720 A | | 12/1996 | Elswick | 439/369 |
| 5,685,732 A | | 11/1997 | Lane | 439/369 |
| 5,713,753 A | | 2/1998 | Bayer et al. | 439/369 |
| 5,755,588 A | | 5/1998 | Sweatman et al. | 439/369 |
| 5,762,515 A | | 6/1998 | Mele | 439/367 |
| 5,772,462 A | | 6/1998 | Osten | 439/367 |
| 5,782,649 A | | 7/1998 | Aiken | 439/369 |
| 5,813,879 A | | 9/1998 | Russo | 439/367 |
| D407,377 S | | 3/1999 | Landerholm et al. | D13/154 |

(Continued)

*Primary Examiner*—Truc Nguyen
(74) *Attorney, Agent, or Firm*—Michael F. Petock, Esq.

(57) ABSTRACT

A power cord plug and jack retainer includes a first and second mating sections. The first and second sections are adapted to mate such that the first section is female and the second section is male. The sections are provided with rhombic shaped pins and slots which lock in place against resilient forces provided by resilient pads and resilient straps. The retainer is provided with conical end portions to prevent snagging but is provided with hooks on the jack side of the conical portion for hooking the retainer on a suitable support such as a belt, ladder, branch or any other suitable support. The second section with the hooks on the conical portion may be used to hang a cord of a power tool or any other item having a cord with an enlarged portion. Any tool may be hung by a rope by placing a knot in the rope and hanging it from the second section.

31 Claims, 5 Drawing Sheets

U.S. PATENT DOCUMENTS

| | | | | |
|---|---|---|---|---|
| 5,913,692 | A | 6/1999 | Targett | 439/369 |
| 6,056,580 | A | 5/2000 | Cross et al. | 439/369 |
| 6,080,004 | A | 6/2000 | Kovacik et al. | 139/369 |
| 6,099,340 | A | 8/2000 | Florentine | 439/367 |
| 6,171,132 | B1 | 1/2001 | Schmidt | 439/369 |
| 6,234,823 | B1 | 5/2001 | Fuess | 439/346 |
| 6,250,946 | B1 | 6/2001 | Tardy | 439/367 |
| 6,305,962 | B1 | 10/2001 | Maher et al. | 439/287 |
| 6,454,576 | B1 | 9/2002 | Hedrick et al. | 439/105 |
| D464,325 | S | 10/2002 | Peters et al. | D13/156 |
| 6,478,601 | B2 | 11/2002 | Oswald | 439/369 |
| 2002/0115353 | A1 | 8/2002 | Zeiler et al. | 439/660 |

* cited by examiner

POWER CORD PLUG AND JACK RETAINER AND HANGER

FIELD OF THE INVENTION

The present invention relates to a power cord plug and jack retainer and hanger. More particularly, the present invention relates to a power cord plug and jack retainer and hanger which is effective in holding a power cord plug and jack together and also effective in enabling the hanging of the retainer from a support.

BACKGROUND OF THE INVENTION

Power cords in the form of cords on tools, implements and appliances and their use in connection with extension cords, or multiple extension cords, is widespread. Carpenters and other journeymen working with electric power tools often need to plug a power tool into an extension cord and move about a job site. Unfortunately, as the worker, homeowner or other user of a power tool, implement or appliance moves around, the power cord plug often pulls out of the jack of an extension cord or, if multiple extension cords are connected together, the plug of one extension cord pulls out of the jack of the other extension cord. This is very disruptive of the effort to try to accomplish whatever is being accomplished with the power tool, implement or appliance. Even a person cutting hedges has to stop, put the hedge cutter down and reestablish the connection between the plug and jack. In other situations where a worker is up on a ladder or a roof, it may require descending the ladder or descending the building from the roof to remake the connection.

The problems alluded to above have been of a long standing nature. Much effort has been devoted to attempting to produce an effective means to hold plugs and jacks of extension cords and the like together. A few examples of efforts in this regard include those described in U.S. Pat. No. 5,306,176—Coffey; U.S. Pat. No. 4,940,424—Odbert;U.S. Pat. No. 4,927,377—Bach et al.; U.S. Pat. No. 3,030, 601—Krebs and U.S. Pat. No. 5,443,397—Carl. The present invention provides a new and improved retainer and provides an effective means of providing a plug and jack retainer and a means for hanging the retainer from a support.

SUMMARY OF THE INVENTION

An advantage of the present invention is that it is effective in holding a power cord plug and jack together.

In accordance with the present invention, the power cord plug may be a power cord plug of a power tool, implement, appliance or any other electrical apparatus which requires power. The jack may be connection of a power cord in the form of an extension cord or other power cord.

Another advantage of the present invention is that the retainer does not snag on other objects as it is pulled.

Another advantage of the present invention is that it is easy to insert the power cord plug and jack into the retainer.

Another advantage of the present invention is that the retainer is effectively held connected together by pins and slots in connection with resilient forces.

Another advantage of the present invention is that the cord may be conveniently inserted by means of a flap and readily retained therein by the flap.

Another advantage of the present invention is that the flap may be forcibly bent outwardly to remove the cord.

Another advantage of the present invention is that it provides an adjustable male-female connection which is adjustably lockable by resiliently biased pins and slots which are snag free.

Another advantage of the present invention is that it is provided with one or more hooks for attaching to a support such as a ladder, nail, hook, opening in a metal stud, limb, pipe, belt of a person or any other suitable support.

Another advantage of the present invention is that at least one of the hooks may be provided with holes or openings for receiving a hook or a rope on which the retainer may be hung.

Another advantage of the present invention is that the hooks are mounted on a second section of the retainer which receives the jack of a power cord thereby firmly supporting the jack and jack power cord when the retainer is hooked on a support.

Briefly and basically, in accordance with the present invention, a power cord plug and jack retainer includes first and second mating sections. The first and second mating sections are adapted to mate such that the first section is female and the second section is male. The first female section is provided with at least one inwardly projecting pin and the second male section has at least one locking slot for receiving the pin of the first section when the first and second sections are connected together. The first section and the second section are provided with a conical end portion and the conical end portions of the first and second sections are provided with flaps allowing power cords to be easily passed into the conical sections, but being retained in the conical sections by the flaps.

In another aspect of the present invention, the power cord plug and jack of the present invention includes the concept of a first and second mating section with the first and second mating sections being adapted to mate such that the first section is female and the second section is male. The first section and the second section are provided with conical end portions with the first section being adapted to receive a power cord plug and the second section being adapted to receive a power cord jack with at least one hook formed on the conical end portion of the second section. The hook formed on the second section points in the direction of the jack power cord whereby the retainer may be hung or releasably attached to a support while firmly holding and supporting the jack power cord and jack.

In a preferred embodiment of the present invention, the retainer is provided with resilient pads mounted in each of the first and second sections for applying force to a plug and jack within the retainer thereby firmly retaining the plug and jack together and insuring that the retainer sections do not separate.

In another preferred aspect of the present invention, the resilient pad is provided with resilient reinforcing straps passing through and behind the resilient pads and mounted to the inner portion of the first and second sections of the retainer.

In another preferred aspect of the present invention, the resilient reinforcing straps are mounted to the inner portions of the first and second sections of the retainer by rings mounted in resilient snap receptacles.

In accordance with another preferred aspect of the present invention, the pin on the first section projects inwardly for a distance equal to the thickness of the wall of the second section thereby preventing any interference on either the outside or the inside of the retainer.

In accordance with another preferred aspect of the present invention, the pin may have flat sides in cross section and may engage slanted slots in the second section.

In accordance with another aspect of the present invention, two sets of three inwardly projecting pins may be provided on the first section and two sets of three slots slanting towards the female section may be provided in the second section.

In accordance with another preferred aspect of the present invention, in addition to the pins and slots having a rhomboid shape in plan view, the side walls of the pins and slots may be slanted at an angle to normal or perpendicular of the side wall of the cylindrical sections.

Another aspect of the present invention is that the second section or the male section may be used independently of the first section as a hanger for a power tool or for any other cord having an enlarged portion.

In accordance with this aspect of the invention, a hanger is provided for hanging an item having a cord with an enlarged portion on the cord. The enlarged portion on the cord may be a plug of a power cord or it may be a knot in a cord or any other enlarged portion. In accordance with this aspect of the present invention, a cylindrical section is provided having a cylindrical wall. A conical end portion is provided on the cylindrical section having a substantially conical wall. The cylindrical section is provided with a longitudinal opening in its cylindrical wall and the conical end portion is provided with a longitudinal opening in its conical wall. A flap is provided in the longitudinal opening of the conical wall which is easily deflected inwardly to receive a cord, but is more resistant to bending outwardly to release the cord. At least one hook is formed on the conical end portion for hanging a combined cylindrical section and conical end portion. The enlarged portion on the cord may be retained within the cylindrical section and the conical end portion when the cord is inserted into the longitudinal slots of the cylindrical section and the conical end portion. In this manner, whatever is attached to the cord with the enlarged portion may be hung by the hook. In many cases, the enlarged portion would be a power cord plug on an electrical cord of a power tool, but it could be any enlarged portion such as a knot in a rope.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENTS

Figure 1:
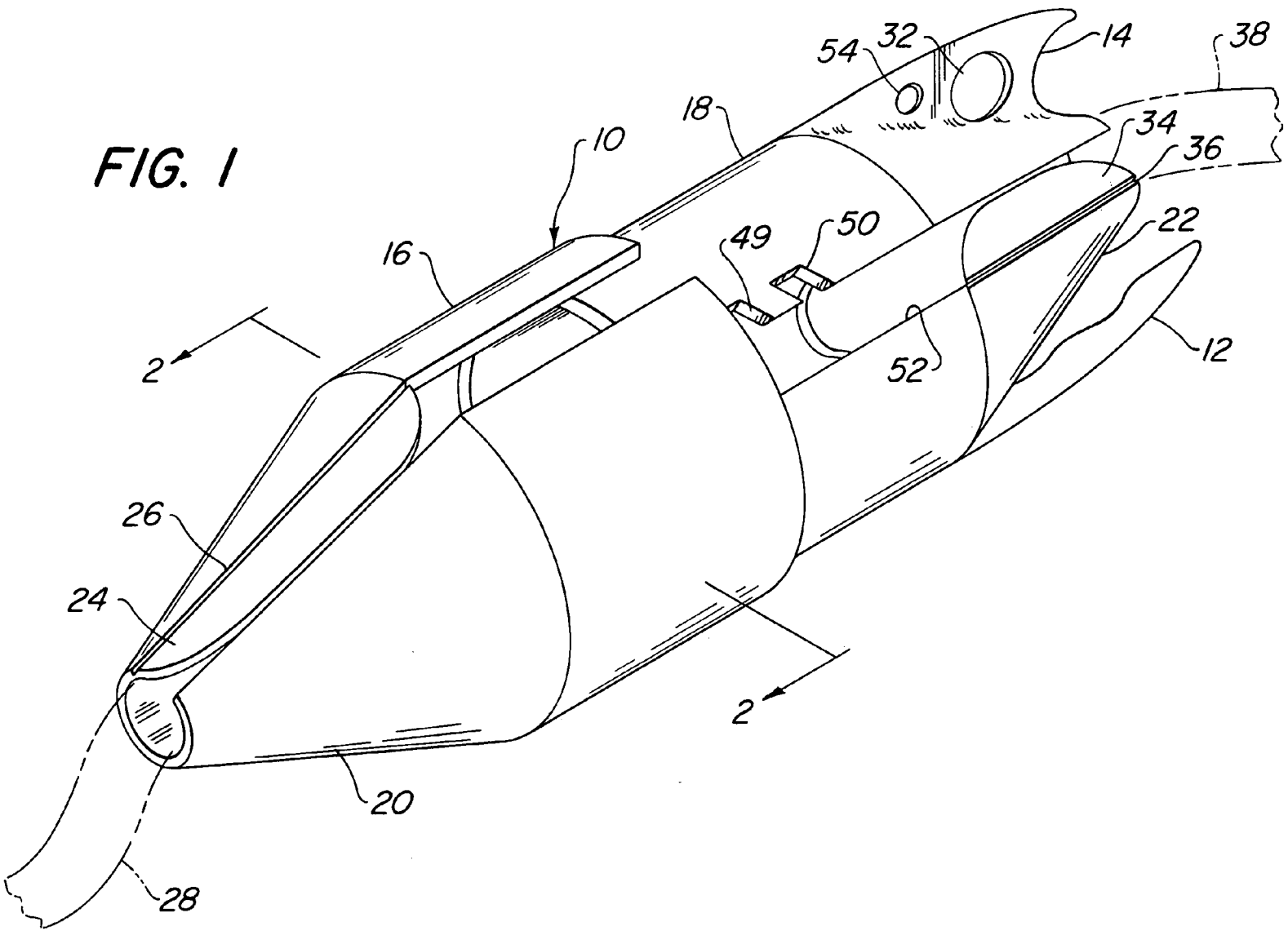
FIG. 1 is a view in perspective of a power cord plug and jack retainer and hanger in accordance with the present invention.
Figure 5:
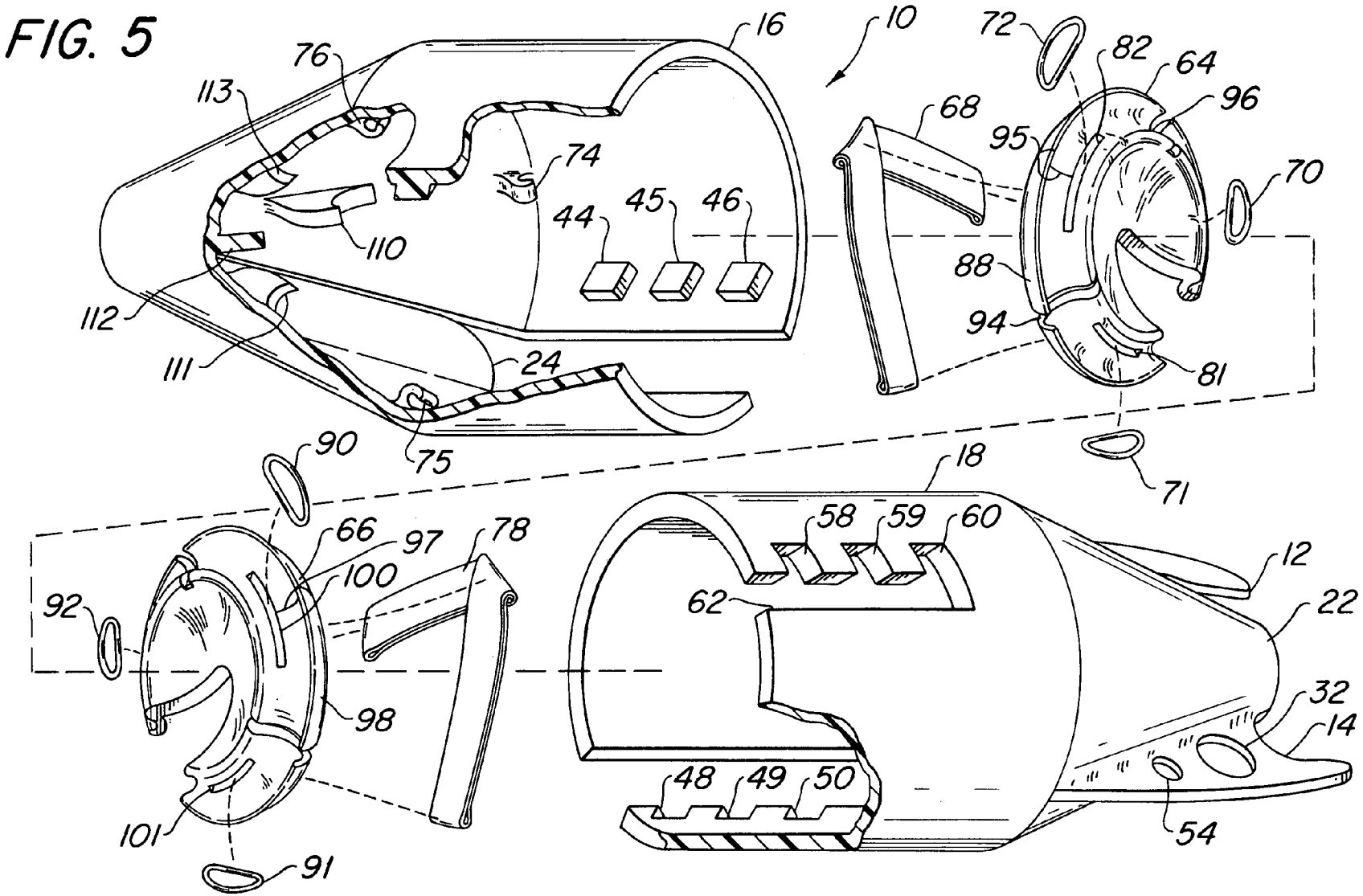
FIG. 5 is an exploded view in perspective, partially broken away, of a power cord plug and jack retainer and hanger in accordance with the present invention illustrating in more detail the component parts.

Referring now to the drawings wherein like numerals indicate like elements, there is shown in FIGS. 1 and 5 a power cord plug and jack retainer 10 which includes hangers 12 and 14. Power cord plug and jack retainer 10 is comprised of a first section 16 and a second section 18. First section 16 is female in that it receives second section or male section 18.

Referring now more particularly to FIG. 1, it may be seen that first section 16 is provided with a conical end portion 20 and second section 18 is provided with a conical end portion 22. The conical end portions prevent snagging on other objects when the power cord plug and jack retainer is pulled while retaining a plug and a jack of two power cords.

Conical end portion 20 is provided with a flap 24 which is integrally connected with conical end portion 20 but separated from conical end portion 20 by an external groove 26 which only partially penetrates the material comprising conical end portion 20 and flap 24. A small internal groove 25 may be provided opposite external groove 26 to enhance flexibility and durability of the hinge effect of flap 24. Grooved flap 24 allows the power cord 28, which is preferably the plug power cord, to be readily inserted within conical end portion 20 of first female section 16 by pressing flap 24 inwardly as shown by arrow 30 in FIG. 2. Once power cord 28 is inserted into first female section 16 and conical end portion 20 by depressing flap 24, flap 24 is allowed to spring back to its original position as shown in FIG. 1 retaining power cord 28 within first conical end portion 20.

In a similar manner, second male section 18 is provided with flap 34. Flap 34 is integrally connected with conical end portion 22 and separated therefrom by external partial groove 36. Power cord 38 may be inserted into second section 18 and particularly into conical end portion 22 thereof by depressing flap 34 as described with respect to flap 24. Preferably power cord 38 is provided with a jack on its end for mating connection with the plug of power cord 28.

The flaps 24 and 34 may be constructed such that they are more easily bent inwardly and are more difficult to bend outwardly. In this manner, the cords 28 and/or 38 may be easily inserted into the first and second section by bending the flaps inwardly, but they are retained within the sections because the flaps are difficult to bend outwardly. However, the flaps may be bent outwardly for removal of the cord. Furthermore, the cord may also be removed by pressing the flap inwardly with a finger, holding it in while the cord is removed.

Figure 2:
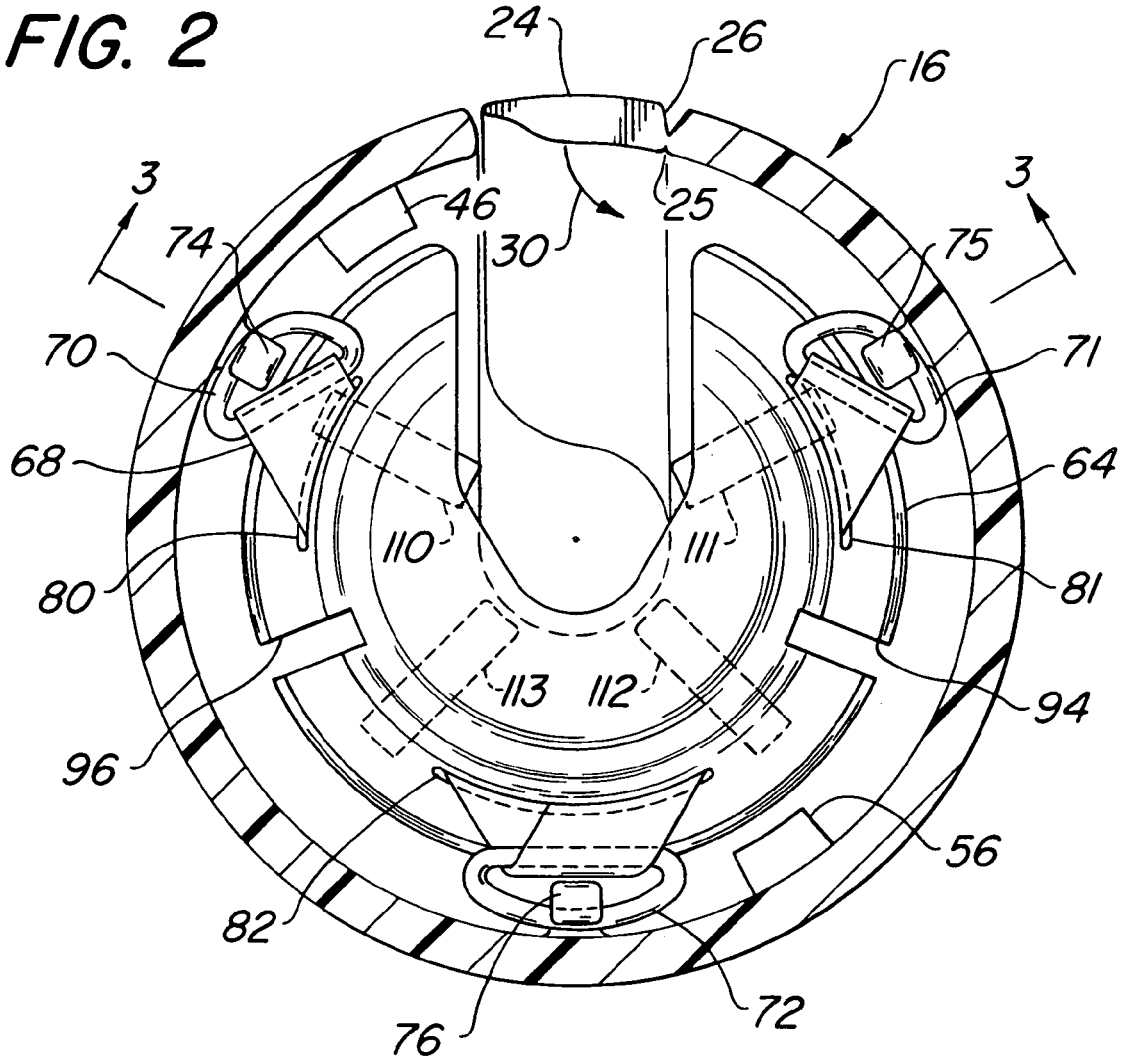
FIG. 2 is a view in cross section taken along line 2—2 of FIG. 1.
Figure 3:
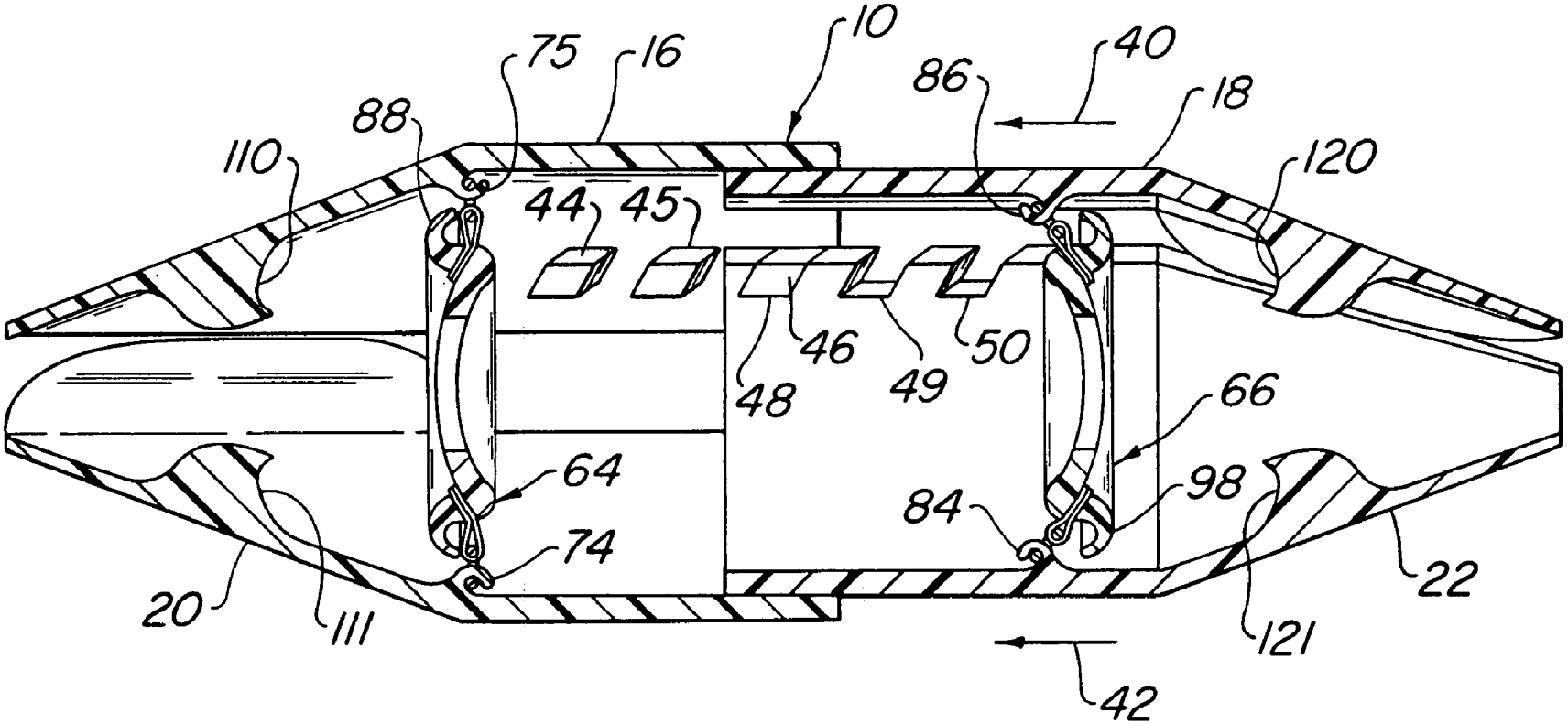
FIG. 3 is a view in cross section taken along line 3—3 of FIG. 2.

Referring now more particularly to FIGS. 1, 3, 4 and 5, it may be seen that second male section 18 is inserted in the direction of arrows 40 and 42, shown in FIG. 3, into first female section 16. Female section 16 is provided with at least one inwardly directed pin, and in a presently preferred embodiment is provided with two sets of three inwardly directed pins. The inwardly directed pins 44, 45 and 46 are best illustrated in FIGS. 3 and 5. The inwardly directed pins 44, 45 and 46 do not project from the external surface and therefore cannot snag anything externally. Furthermore, the inwardly projecting pins 44, 45 and 46 are of a height equal to the wall thickness of second section 18 and therefore do not project into the central space of retainer 20. Inwardly projecting pins 44, 45 and 46 may be of any suitable shape in cross section, but in a presently preferred embodiment, these would be of rhomboid shape. In other words, pins 44–46 would have flat sides and in cross section would be a parallelogram or rhombus. These sloping or slanting sides of pins 44, 45 and 46 mate with slots 48, 49 and 50. Slots 48, 49 and 50 are formed off of longitudinal slot 52 and slope toward first female section 16 as shown in FIG. 3. As may be best seen in FIGS. 2 and 5, a second set of three pins and a second set of three slanted slots formed off of a longitudinal slot are provided diametrically opposite in the retainer. For example, in FIG. 2, there is shown, diametrically opposite pin 46, a pin 56. Pin 56 would preferably be the first of a set of three pins which would mate with one of slots 58, 59 and 60, best seen in FIG. 5. Slanted slots 58, 59 and 60 are formed off of longitudinal slot 62. In effect, in a presently preferred embodiment, there are two sets of three pins and three slanted slots off of a longitudinal slot diametrically arranged to provide an adjustable locking engagement between the first section 16 and the second section 18 of the retainer. In a presently preferred embodiment, not only would the pins and slots have slanted or parallelogram shapes, but the side walls of the pins and slots would be slanted. This can be seen to at least some degree with the slots 58, 59 and 60 in FIG. 5.

In a presently preferred embodiment, resilient pads are mounted in each of first section 16 and second section 18 for applying force to a plug and jack within retainer 10. The force applied to the plug and jack tends to force the plug and jack together thereby helping to hold or retain them together and also creates forces between the slanted pins and the slanted slots to help hold the two sections of the retainer together.

Referring now to FIG. 2, there is shown a resilient pad 64 mounted in first section 16. FIG. 5 illustrates pad 64 in first section 16 and resilient pad 66 in second section 18.

Referring now to FIGS. 2 and 5, it may be seen that resilient pad 64 is provided with resilient reinforcing strap 68 which passes through and behind resilient pad 64. Resilient strap 68 is mounted to the inner portion of first section 16 by rings 70, 71 and 72 which are mounted in resilient snap fit receptacles 74, 75 and 76. Resilient snap fit receptacles 74–76 may be constructed of resilient material such that the rings 70–72 snap into the receptacle or notch therein and are retained therein by the resilient arm of the snap fit receptacle. Preferably, but not necessarily, resilient straps 68 and 78 may be comprised of a double layer or double thickness for additional strength as shown in FIG. 5.

Resilient reinforcing strap 68 passes through openings 80, 81 and 82 in resilient pad 64. In this manner, resilient strap 68 passes through openings 80–82 and behind resilient pad 64 to provide support. As described above, resilient reinforcing strap 68 is mounted to the inner portion of the first section 16 by means of rings 70–71 and resilient snap fit receptacles 74–76.

In a similar manner, as illustrated in FIG. 5, resilient pad 66 is mounted by means of resilient reinforcing strap 78 which is mounted via rings 90–92 to the inner portion of second section 18 by resilient snap fit receptacles (not shown) similar to snap fit receptacles 74–76 shown and described. Strap 78 passed through openings 100, 101 and 102 in resilient pad 66, passes behind resilient pad 66 and reinforces and supports resilient pad 66. The structure and arrangement for second resilient pad 66 is the same as that as described for resilient pad 64.

Figure 4:
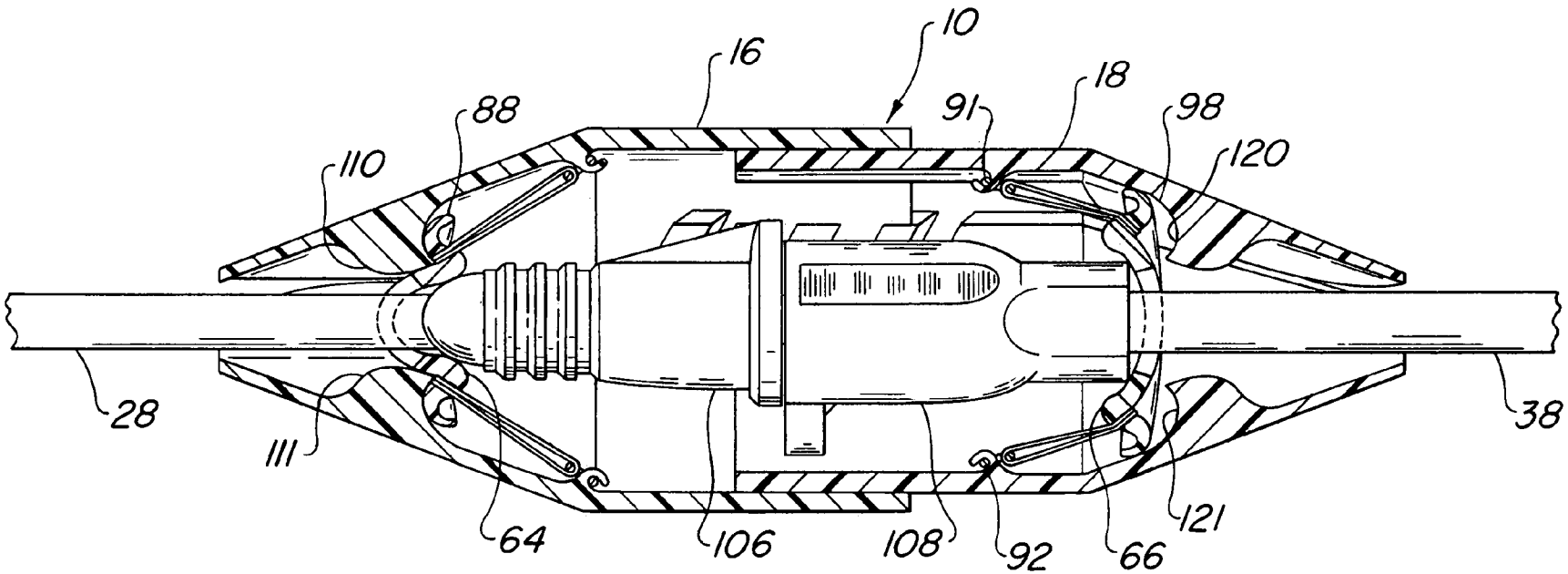
FIG. 4 is a cross sectional view of a power cord plug and jack retainer and hanger in accordance with the present invention including a power cord plug and jack therein, the cross sectional view corresponding to that of FIG. 3.

Resilient pad 64 is provided with a roll edge 88 and resilient pad 66 is provided with a roll edge 98. Roll edges 88 and 98 are provided to provide smooth but forceful resilient movement of the resilient pads 64 and 66 as they are forced into the conical end portions of their respective first section 16 and second section 18, being compressed as may be best seen in FIG. 4. Roll edges 88 and 98 on resilient pads 64 and 66, respectively, are compressed back into the conical section providing significant resilient force from the resilient pads to plug 106 and jack 108 to retain them together. This resilient force is augmented by the resilient reinforcing straps. Again, the roll edges are compressed against the inner side walls of the first and second section as shown in FIG. 4.

Further, to enable movement by the resilient pads within their respective sections, the resilient pads are provided with radial openings around their periphery. For example, referring to FIGS. 2 and 5, resilient pad 64 is provided with radial openings 94 and 96 and relief cut 95. Similar radial openings and a similar relief cut 97 are shown in resilient pad 66 in FIG. 5. Radial openings 94 and 96 and relief cut 95 enable the pad to more easily move back into the smaller diameter or conical end portion of first section 16. The conical end portion of first section 16 is provided with a set of four stops 110, 111, 112 and 113. When the cords of plug 104 and jack 106 are inserted in retainer 10 and the first section of retainer 16 and the second section 18 are connected together by means of the pins and slots, as shown in FIG. 4, the resilient pads 64 and 66 are forced back into the respective conical end portions of the sections, again as shown in FIG. 4. Depending upon the exact size of the plug and jack and the degree to which the first section and the second section are forced together, resilient pads 64 and/or 66 may contact the stops. As shown in FIG. 4, resilient pad 64 is in contact with stops 110 and 111. However, in the particular situation shown in FIG. 4, resilient pad 66 does not quite make contact with resilient stops 120 and 121. Nevertheless, the stops are provided as a limit on the movement of the resilient pads.

First section 16 and the second section 18 may be forced together to varying degrees as provided by the series of two sets of three pins and the two sets of the three slanted slots. This depends upon how far second section 18 is inserted into first section 16 when it is locked in position. For example, as illustrated in FIG. 3, only one pin 46 is inserted into slot 48. Second section 18 could have been adjusted where two pins 45 and 46 were in slanted slots or could have been adjusted where all three pins 44, 45 and 46 were in slots 48, 49 and 50, respectively. In other words, a degree of adjustability is provided by the multiple pins in multiple slots.

In practicing the present invention, a power cord 28 may be inserted into first section 16 by depressing flap 24. Power cord 28 is provided with a plug 106 as shown in FIG. 4. Another power cord 38 is inserted into second section 18 by depressing flap 34. Power cord 38 is provided with jack 106. At this point in time, plug 106 and jack 108 may be connected together and second section 18 and first section 16 are brought together by insertion of male second section 18 into female first section 16 by a desired amount against the resilient force of pads 64 and 66 with their reinforcing resilient straps 68 and 78. The first section 16 and the second section 18 are locked together by twisting or turning the one section with respect to the other section to lock one or more of the pins 44 through 46 into one or more of the slots 48–50. It is understood that diametrically opposite pins and slots are also engaged at the same time. Diametrically opposite pins are engaged into the diametrically opposite slots 58–60.

Another inventive aspect of the present invention is the provision of one or more hooks on conical end portion 22 of second section 18. Referring now to FIGS. 1 and 5, there is shown a first hook 12 formed on conical end portion 22. Hook 12 may be elongated as illustrated in FIG. 1 and may be suitable for hanging of retainer 10 on various supports including a hole in a metal stud or a belt of a person or worker.

A second hook may also be provided on conical end portion 22 of second section 18. It is understood that one, two or more hooks may be utilized on conical section 22. However, in a presently preferred embodiment, two hooks would be provided on conical end portion 22. Hook 14 is provided at its end with a more shallow opening and may be suitable for hanging on various supports including a pipe, limb or other support. Second hook 14 may also be provided with openings 32 and 54 wherein retainer 10 may be hung from a hook attached to a support including a hook on a workers belt or a hook on a pipe, appliance, ladder or any other support. Alternatively, openings 32 and/or 54 may be used to pass a rope through them for the holding of the retainer. One retainer or a plurality of retainers may have a rope passed through one of the openings, such as opening 32 on second hook 14 with the rope ends being tied together to form a loop and the loop being passed over the vent pipe on a roof to hold a plurality of retainers and tools associated with the retainers via their power cords.

It is presently preferred that the hooks be provided only on the section which contains the jack power cord. The jack power cord is the cord, such as an extension cord, which goes back to the power source. The plug cord which preferably, as illustrated in FIG. 4, is contained in first female section 16, would be the plug power cord from the power tool, implement or other appliance which may be being used by the worker or other person. In this manner, when retainer 10 is hung on a suitable support, the power cord jack end is supported in the normal manner. The power cord plug end 28 flows out of first female section in a natural manner for use by the worker or other person.

In practicing the present invention, sections 16 and 18 may be comprised of any suitable rigid material such as various synthetic plastics. The resilient pads may be constructed of various synthetic plastics or other resilient material. The resilient reinforcing straps may be constructed of any suitable resilient material including knitted, woven, composite or rubber elastic bands.

Another inventive aspect of the present invention is using second section 18, without first section 16, for hanging an item having a cord with an enlarged portion on the cord. Typically, the cord will be a power cord and the enlarged portion on the cord may be the plug of the power cord. However, other cords may be used, including rope with a knot tied in it to form the enlarged portion on the cord. In this manner, section 18 may be used as a hanger for various items.

Although typically section 18 would have the resilient pad and the resilient straps therein, these would not be necessary for use of the second section as a hanger for tools or other items. A hanger of this type would utilize a cylindrical section 18 which has a cylindrical wall. Conical end portion 22 is provided with a substantially conical wall. The cylindrical section is provided with a longitudinal opening 52 in its cylindrical wall. The conical end portion is provided with a longitudinal opening having a flap 34 which is easily deflected inwardly to receive a cord but is more resistant to bending outwardly to release the cord. At least one hook is formed on the conical end portion for hanging the combined cylindrical section and conical end portion. This hook may be hooks 14 or 12. In this manner the enlarged portion of a cord may be retained within the cylindrical section and the conical end portion when the cord is inserted into the longitudinal slots in the cylindrical section and the conical end portion whereby the same may be hung by the hook.

In hanging the hanger, the person may choose longitudinal shaped hanger 12 to hang a tool or other object from a metal stud or a belt of a person. In other words, the longitudinal hanger may be inserted into one of the holes of a metal stud or on the belt of a person. Alternatively, hook 14 may be utilized to hang the hanger using the end portion of hook 14 from a pipe, limb or any other suitable support. Alternatively, holes 32 and/or 54 may be utilized to hang the hanger on hooks or to pass a rope through one of the openings 32 or 54 to tie the tool to any suitable support, such as the vent pipe on a roof. If it is necessary to hang a plurality of tools, a plurality of hangers may be utilized by passing a loop of rope through one of the openings, such as opening 32, and hanging the loop of rope on any suitable support available, such as the vent pipe on a roof.

Although it is presently a preferred embodiment to have the flap constructed such that it moves inwardly and outwardly, moving inwardly much more easily than it moves outwardly, it is understood that the flap may be a one-way flap. The flap could be constructed such that it would only move inwardly and would not move outwardly. In such an embodiment, the flap would be bent inwardly to insert the cord and would have to be bent inwardly and held inwardly with a finger to allow the cord to be removed.

The present invention may be embodied in other specific forms without departing from the spirit or essential attributes thereof and, accordingly, reference should be made to the appended claims, rather than to the foregoing specification as indicating the scope of the invention.

I claim:

1. A power cord plug and jack retainer comprised of:

a first and a second mating section;

said first and second mating sections being adapted to mate such that said first section is female and said second section is male;

said first female section having at least one inwardly projecting pin and said second male section having at least one locking slot for receiving said pin of said first section when said first and second sections are connected together;

said first section and said second section being provided with a conical end portion; and said conical end portions of said first and said second sections being provided with a flap allowing power cords to easily pass into said conical section, but being retained in said conical section by said flap.

2. A power cord plug and jack retainer in accordance with claim 1 including a resilient pad mounted in each of said first and second sections for applying force to a plug and a jack within the retainer.

3. A power cord plug and jack retainer in accordance with claim 2 wherein said resilient pad is provided with resilient reinforcing straps passing through and behind said resilient pads and mounted to the inner portion of said first and second sections.

4. A power cord plug and jack retainer in accordance with claim 1 wherein said at least one locking slot is in the form of a longitudinal slot and a slot slanting towards said first female section.

5. A power cord plug and jack retainer in accordance with claim 1 wherein said first female section is provided with two sets of three inwardly projecting pins.

6. A power cord plug and jack retainer in accordance with claim 4 wherein said second male section has two sets of three slots slanting towards said female section.

7. A power cord plug and jack retainer in accordance with claim 3 wherein said resilient reinforcing straps are mounted to the inner portion of said first and second sections by rings mounted in resilient snap fit receptacles.

8. A power cord plug and jack retainer in accordance with claim 1 wherein said conical end portion of said second section is provided with a hook for hanging said retainer.

9. A power cord plug and jack retainer in accordance with claim 8 including a second hook formed on said conical end portion of said second section.

10. A power cord plug and jack retainer in accordance with claim 9 wherein said second hook is provided with openings.

11. A power cord plug and jack retainer in accordance with claim 1 wherein said flaps are offset from each other when said first and second mating sections are mounted together.

12. A power cord plug and jack retainer in accordance with claim 1 wherein said second male section is provided with a predetermined wall thickness and said at least one inwardly projecting pin has a length equal to said predetermined wall thickness of said second section.

13. A power cord plug and jack retainer in accordance with claim 1 wherein said pin has flat sides in cross section.

14. A power cord plug and jack retainer in accordance with claim 13 wherein said flat sided pin is in the shape of a rhombus in cross section.

15. A power cord plug and jack retainer in accordance with claim 3 wherein said resilient reinforcing straps are of double thickness.

16. A power cord plug and jack retainer in accordance with claim 2 wherein said resilient pad mounted in each of said first and second sections is provided with a shape to provide a rolling edge.

17. A power cord plug and jack retainer in accordance with claim 16 wherein said first and second sections are provided with stops for receiving the rolling edge of said resilient pads.

18. A power cord plug and jack retainer in accordance with claim 1 wherein said first section receives a plug of a power cord and said second section receives a jack of a power cord.

19. A power cord plug and jack retainer in accordance with claim 4 wherein said slot slanting towards said first female section is in the shape of a rhombus.

20. A power cord plug and jack retainer in accordance with claim 6 wherein each slot of said two sets of three slots slanting towards said female section is in the shape of a rhombus.

21. A power cord plug and jack retainer in accordance with claim 1 wherein said first female section and said second male section are provided with adjustable locking means to adjust the degree of insertion of said second male section into said first section.

22. A power cord plug and jack retainer in accordance with claim 3 wherein said resilient pad is provided with one or more radial openings.

23. A power cord plug and jack retainer comprised of:

a first and a second mating section;

said first and second mating sections being adapted to mate such that said first section is female and said second section is male;

said first section and said second section being provided with a conical end portion;

said first section being adapted to receive a power cord plug and said second section being adapted to receive a power cord jack; and at least one hook formed on said conical end portion of said second section, said hook pointing in the direction of the jack power cord whereby said retainer may be hung or releasably attached to a support.

24. A power cord plug and jack retainer in accordance with claim 23 wherein a second hook is formed on said conical end portion of said second section.

25. A power cord plug and jack retainer in accordance with claim 24 wherein said second hook is provided with openings wherein said retainer may be hung from a hook.

26. A power cord plug and jack retainer in accordance with claim 23 wherein said at least one hook formed on said conical portion of said second section is an elongated hook.

27. A hanger for hanging an item having a cord with an enlarged portion on the cord, comprising:

a cylindrical section having a cylindrical wall;

a conical end portion on said cylindrical section having a substantially conical wall;

said cylindrical section being provided with a longitudinal opening in its cylindrical wall;

said conical end portion having a longitudinal opening in its conical wall and a flap in said longitudinal opening which is easily deflected inwardly to receive a cord, but more resistant to bending outwardly to release said cord;

at least one hook being formed on said conical end portion for hanging said combined cylindrical section and said conical end portion; and whereby said enlarged portion on said cord may be retained within said cylindrical section and said conical end portion when the cord is inserted into said longitudinal slots of said cylindrical section and said conical end portion and whereby the same may be hung by said hook.

28. A hanger in accordance with claim 27 wherein said cord is an electrical cord of a power tool and said enlarged portion on said cord is a power cord plug.

29. A hanger in accordance with claim 27 wherein said conical end portion is provided with two hooks.

30. A hanger in accordance with claim 29 wherein at least one of said hooks is provided with an opening therein.

31. A hanger in accordance with claim 29 wherein one of said hooks is elongated.

* * * * *